United States Patent [19]

Stuart

[11] 4,055,343

[45] Oct. 25, 1977

[54] SURFACE PROJECTILE GAME APPARATUS

[76] Inventor: Edwin G. Stuart, 308 Patterson Lane, Florissant, Mo. 63031

[21] Appl. No.: 688,742

[22] Filed: May 21, 1976

[51] Int. Cl.[2] ..... A63F 9/14

[52] U.S. Cl. ..... 273/108; 273/126 R; 273/128 R; 273/127 R; 273/106.5 R; 273/102 S

[58] Field of Search ..... 273/126 R, 128 R, 127 R, 273/108, 106.5 R, 106.5 A, 102.1 F, 102.1 R

[56] References Cited

U.S. PATENT DOCUMENTS

| | | | |
|---|---|---|---|
| 2,353,866 | 7/1944 | Bach | 273/108 R |
| 3,032,345 | 5/1962 | Lemelson | 273/106.5 A |
| 3,401,941 | 9/1968 | Hesidence | 273/106.5 A |
| 3,980,303 | 9/1976 | Bolton | 273/106.5 A |

*Primary Examiner*—Richard C. Pinkham
*Assistant Examiner*—T. Brown
*Attorney, Agent, or Firm*—Harvey A. Gilbert

[57] ABSTRACT

A game having a vertical game board with an adherent surface supported from a horizontal game surface upon which a game piece transporter can be accelerated. The game piece transporter has weight and center of gravity located to prevent tipping and has a height adjustable, changable, adherent element capable of holding onto one side of a game piece, having mating adherent material, during acceleration and transit to or from the game board. The opposite side of the game piece has an adhering material compatible for mating with the adherent surface of the game board, depending upon the relative adherent strengths of the respective mating adherent surfaces, when the game piece transporter is accelerated to the game board. An elastic band is located across the base and in front of the vertical game board in the vicinity of the intersection of the game board and the horizontal game surface. The elastic band permits the game piece transporter to approach the game board close enough to permit removal or deposit of the game piece and rebound and return of the game piece transporter with or without, respectively, the game piece, to the player as the rules of the selected game routine dictate.

9 Claims, 5 Drawing Figures

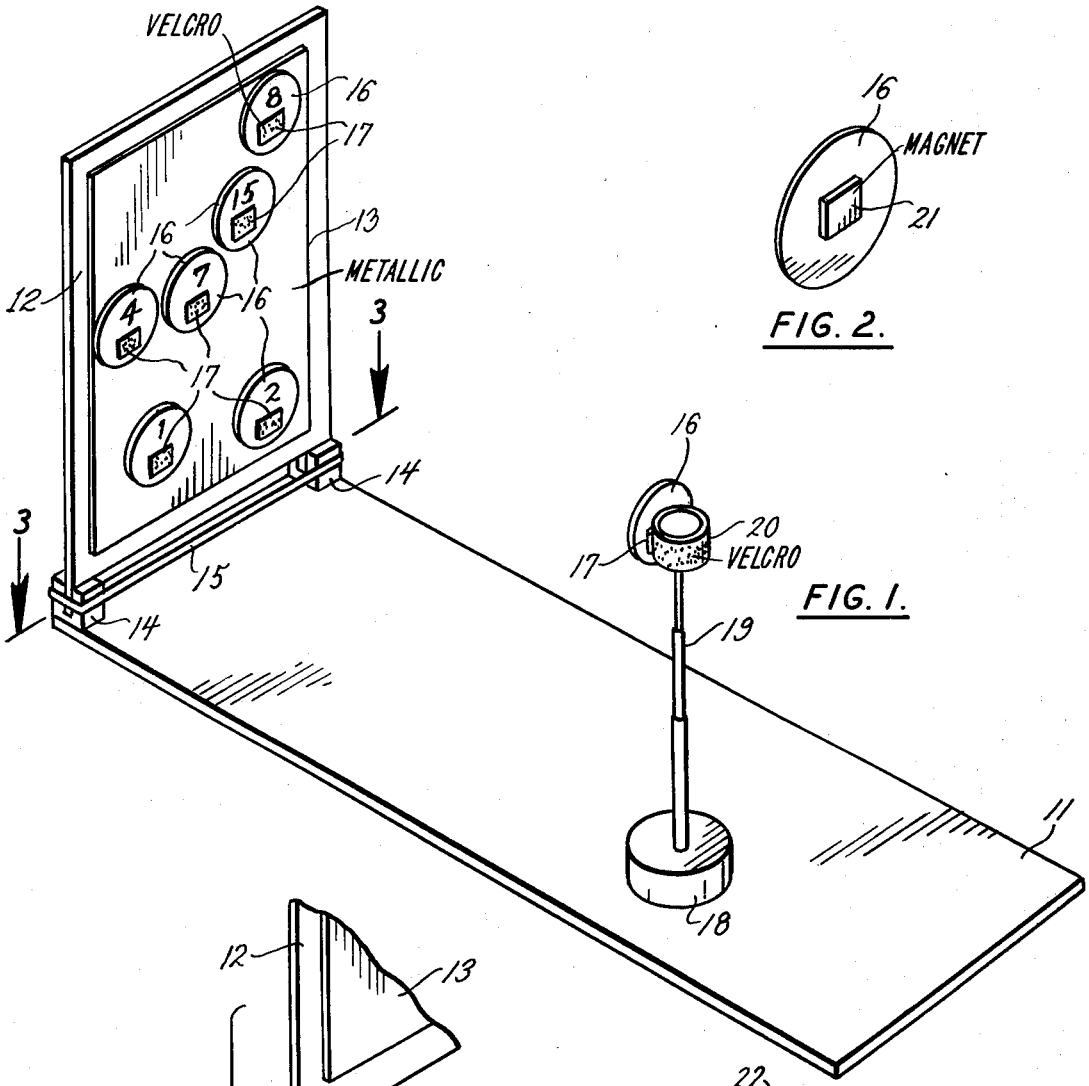
FIG. 1.
FIG. 2.
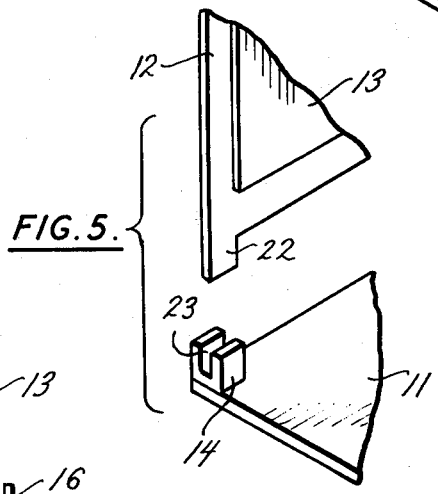
FIG. 5.
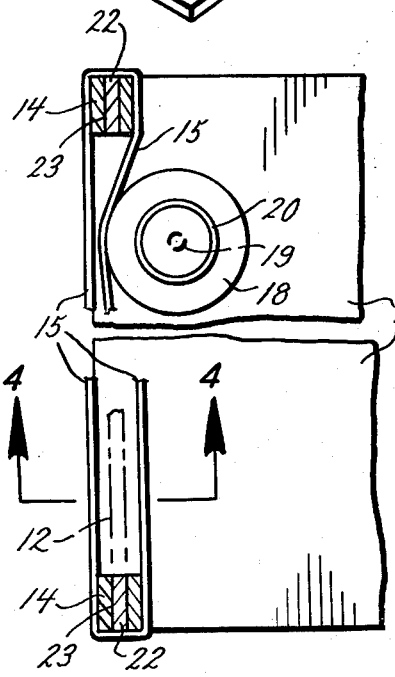
FIG. 3.
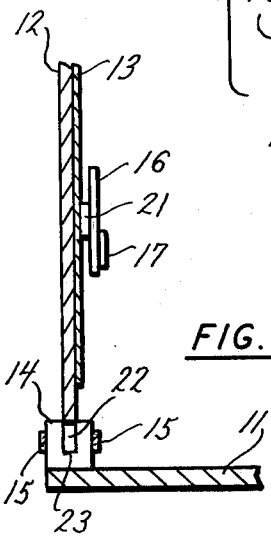
FIG. 4.

SURFACE PROJECTILE GAME APPARATUS

BACKGROUND OF THE INVENTION

The invention is a game mechanized for adaptation to many specific game routines and player skill levels.

SUMMARY OF THE INVENTION

The invention is a game employing a horizontal game surface upon which a player accelerated, height adjustable, game piece transporter travels to deposit or remove a game piece from a particular location upon a vertically oriented game board mounted at an extremity of the horizontal game surface.

A primary object of the invention is to provide a generic game mechanization adaptable to many specific game routines such as billiards, tic tac toe, horseshoes, and other games of skill.

Another object of the invention is to employ two sets of mating adherent means of differing adherent strengths, the mating material of one set upon a vertical gameboard, the mating material of the other set upon a game piece transporter, and the corresponding mating materials of each set, respectively, on each side of a game piece to permit either deposition or removal of the game piece upon or from the game board as a specific game routine dictates.

Another object of the invention is to provide a game mechanization adaptable to a variety of player skill levels.

Yet another object of this invention is to exercise player height perception.

These and other objeccts of the invention will become more apparent upon examination of the accompanying drawing views and the detailed description of the invention.

BRIEF DESCRIPTION OF THE DRAWINGS

FIG. 1 is a perspective view of the game.

FIG. 2 is a perspective view of the game board side of a game piece showing a patch of adherent material.

FIG. 3 is a partial section view through the gameboard supports.

FIG. 4 is a sectional view taken through the vertical game board and the horizontal game surface.

FIG. 5 is a perspective view of the game board support means.

DETAILED DESCRIPTION OF INVENTION AND PREFERRED EMBODIMENT

The invention is depicted in FIG. 1 in perspective for an "Eight Ball" game routine. Gameboard 12 is secured in a vertical orientation relative to horizontal game surface 11, as shown in FIG. 5 by means of supports 14 having slotted receptacles 23 permitting tabs 22 at the base of game board 12 to be snugly inserted therein. Adherent means 13 on game board 12 for the "Eight Ball" game routine is metallic in the preferred embodiment.

In the preferred embodiment horizontal game surface 11 is a smooth plywood board, however, other hardboard, smooth synthetic surfaces, or air bearing surfaces may be employed with compatible game piece transporter 18 materials.

Rebound means 15 is a rubber band stretched about supports 14 below and immediately in front of the bottom of game board 12 as shown in FIGS. 1 and 3. A highly resilient rebound cushion could be employed in lieu of a rubber band for rebound means 15. Game piece transporter 18, shown in FIG. 1 and 3, has shaft 19 rising vertically and thus normal to the flat horizontal game surface 11, and adherent means 20 adjustably mounted upon shaft 19. Although adherent means 20 can be fabricated to friction fit slidably upon shaft 19 of uniform diameter to adjust elevation for contact with mating adhering means 17 on game piece 16, a telescoping shaft 19, as shown in FIG. 1, with adherent means 20 secured to the tip of the uppermost section may also be satifactorily employed.

Game piece transporter 18 must be heavy enough, with a low enough water center of gravity to maintain the vertical orientation of shaft 19 relative to horizontal game surface 11, with or without the additional top load of game piece 16 attached to adherent means 20, at the time of initial acceleration by a player towards game board 12, during deceleration upon impact with rebound means 15, and during rebound acceleration away from game board 12 towards the player. A hard rubber cylinder the size of a regulation hockey puck has been found to be highly satifactory for use in the preferred embodiment from the standpoint of weight, sliding, and wear characteristics when used in conjunction with a smooth plywood board employed as horizontal game surface 11. An alternate embodiment may use captive ball bearings protruding slightly from the underside of game piece transporter 18.

The game board side of game piece 16, representing a billiard ball, is shown in FIG. 2 and 4 with adherent means 21 being magnetic for retention upon metallic adherent means 13 on game board 12. Game piece 16 having adhering means 17 on its surface facing away from gameboard 12 is shown in FIG. 1 in contact with receptive adherent means 20 on game piece transporter 18. In the preferred embodiment of the "Eight Ball" game routine adhering means 17 having a flat bottom is one side of a Velcro-like material and adherent means 20 is the opposite and mating side of such material. In this embodiment the attraction force between magnetic adherent means 21 and metallic adherent means 13 is less than the holding forces between mating Velcro-like adhering means 17 and 20, respectively to permit removal of game piece 16 from game board 12.

FIG. 3, a top, partial sectional view reveals that when game piece transporter 18 has been accelerated by a player into contact with rebound means 15 with sufficient force, and adherent means 20 is of sufficient size, and is positioned at the appropriate elevation on shaft 19 of uniform diameter or at the top of shaft 19 consisting of telescoping sections, contact and secure joinder will be possible between adherent means 20 on shaft 19 of game piece transporter 18 and adhering means 17 and adhering means 17 on the front side of game piece 16 as shown in FIG. 4. At the instant of contact and joinder the game piece is simultaneously in contact with gameboard 12 and adherent means 20 on shaft 19. The result of such joinder and subsequent release of stored energy in rebound means 15 is removal of game piece 16 from gameboard 12 and return attached to adherent means 20 on game piece transporter 18 to the player.

In an alternate game routine embodiment, such as for Tic Tac Toe, where game pieces, Xs and Os, are deposited on the game board, rather than removed as in "Eight Ball," adherent means 13 on game board 12 should be one side of a Velcrolike material and the mating adhering means 21 on the surface of game piece 16 facing game board 12 should be the opposite side of the Velcro-like material. Correspondingly, adherent means 20 on game piece transporter 18 should be positioned at the appropriate elevation on shaft 19 of uniform diameter or at the top of shaft 19 consisting of telescoping sections and should be metallic or magnetic to mate with a magnetic or metallic adhering means 17, respectively on the surface of game piece 16 facing the player. In this embodiment the magnetic attraction between adherent means 20 and adhering means 17 must be less than the retention forces acting between adherent means 13 and mating adhering means 21 to permit deposition of game piece 16 on game board 12.

It should be further noted that by adjusting the size of adhering means 17 on game piece 16 or the size of adherent means 20 on game piece transporter 18, or both, the skill requirements for the many game routines possible with the subject invention may be varied considerably.

Although the invention has been shown and described with respect to preferred embodiments thereof, it should be understood by those skilled in the art that the foregoing and various other changes and omissions in the form and detail thereof may be made therein without departing from the spirit and scope of the invention.

What I now claim is:

1. A game apparatus comprising, in combination, an elongated horizontal game playing surface, a game board having an adherent surface, support means at one end of said game playing surface supporting said game board in a substantially vertical plane such that said adherent surface is facing in the direction of the other end of said game playing surface, a rebound means; said rebound means being affixed between at least two points at said one end of said game playing surface immediately in front of, near, and across the base of said game board, a game piece transporter; said game piece transporter having a substantially flat bottom surface and a shaft extending substantially vertically upward therefrom, said shaft having a vertically adjustable adherent means mounted thereon, a game piece having opposite sides; said game piece having adherent means on one of its sides permitting releasable affixation to said adherent surface on said game board and adherent means on the side opposite said one side permitting releasable affixation to said adherent means mounted on said shaft; the adherence between said adherent means on said game board and said one side of said game piece being greater than the adherence between the adherent means on said shaft and said adherent means on said side opposite said one side of said game piece such that when said game piece is attached to said adherent means on said shaft and said game piece transporter is propelled from said other end of said game playing surface and into said rebound means said game piece will be deposited upon said game board adherent surface as said game transporter is rebounded towards said other end of game playing surface of said rebound means.

2. The game of claim 1 wherein said horizontal game surface is smooth to permit sliding of said game piece transporter upon said surface.

3. The game of claim 1 wherein the shaft of said game piece transporter comprises a series of telescoping sections which permit upward and downward positioning of said adherent means upon said shaft to allow depositing of a game piece at a location at a selected elevation on said game board.

4. The game of claim 1 wherein said support means contains a receptacle permitting game board insertion for retention in a vertical orientation relative to said horizontal game surface.

5. The game of claim 1 wherein said rebound means comprises a rubber band.

6. The game of claim 1 wherein the adherent surface of said game board is a piece of Velcro-like material and said adherent means on the side of the game piece intended to contact and hold to said Velcro-like material on said gameboard is the mating side of the Velcro-like material while the adhering means on the opposite side of said game piece is metallic and the adherent means mounted upon the shaft of said game piece transporter is magnetic so that said game piece may be held by said adherent means at an elevation on the shaft of said game piece transporter coinciding with a desired contact point on said game board selected by a player pursuant to a particular game scheme during acceleration of said game piece transporter into said rebound means to an extent permitting contact and meshing of the mating Velcro-like material, and retention upon said game board.

7. A game apparatus comprising, in combination, an elongated horizontal game playing surface, a game board having an adherent surface, support means at one end of said game playing surface supporting said game board in a substantially vertical plane such that said adherent surface is facing in the direction of the other end of said game playing surface, a rebound means; said rebound means being affixed between at least two points at said one end of said game playing surface immediately in front of, near and across the base of said game board, a game piece transporter; said game piece transporter having a substantially flat bottom surface and a shaft extending substantially vertically upwardly therefrom, said shaft having a vertically adjustable adherent means mounted thereon, a game piece having opposite sides; said game piece having adherent means on said opposite sides, the adherence between said adherent means on said game board and the adherent means on one side of said game piece being less than the adherence between the adherent means on said shaft and said adherent means on the side of said game piece opposite said one side such that when said game piece is attached to said adherent means on said game board and said game piece transporter is propelled from said other end of said game playing surface and into said rebound means said game piece will be removed from said game board upon contact between said adherent means on said shaft and said game piece adherent means as the said game piece transporter is rebounded toward said other end of said game playing surface of said rebound means.

8. The game apparatus of claim 1 wherein said shaft of said transporter comprises a series of telescoping sections which permit upward and downward positioning of said adherent means mounted thereon, said positioning of said shaft allows removal of said game piece from various locations on said game board.

9. The game apparatus of claim 8 wherein the adherent surface on said game is metallic and the adherent means on said one side of said game piece for contacting said metallic surface on said game board is a magnet, and said adherent means on said game piece opposite said one side is a piece of Velcro-like material and said adherent means mounted on said shaft is a piece of Velcro-like material for mating with said material on said side opposite said one side of said game piece, said game piece being manually placed at a particular location on said game board and removed by the said adherent means mounted on said shaft after proper vertical adjustment of said adherent means on said shaft and propelling said game piece transporter over said game playing surface towards said game board and rebound means.

* * * * *